US005142751A

United States Patent [19]

Senba

[11] Patent Number: 5,142,751

[45] Date of Patent: Sep. 1, 1992

[54] WEFT STRAIGHTENER

[75] Inventor: Shozi Senba, Osaka, Japan

[73] Assignee: Tsuchiya Machinery Co., Ltd., Kyoto, Japan

[21] Appl. No.: 672,912

[22] Filed: Mar. 21, 1991

[30] Foreign Application Priority Data

Mar. 31, 1990 [JP] Japan ..... 2-87247

[51] Int. Cl.[5] ..... D06C 3/00

[52] U.S. Cl. ..... 26/51.3

[58] Field of Search ..... 26/51.3, 51.4, 51.5

[56] References Cited

U.S. PATENT DOCUMENTS

| | | | |
|---|---|---|---|
| 2,209,220 | 7/1940 | Berry | 26/51.5 |
| 2,698,982 | 1/1955 | Smith et al. | 26/51.4 |
| 3,839,767 | 10/1974 | Leitner et al. | 26/51.5 |
| 4,768,265 | 9/1988 | Hampel | 26/51.3 |
| 4,932,106 | 6/1990 | Senba | 26/51.3 |

FOREIGN PATENT DOCUMENTS

| | | | |
|---|---|---|---|
| 0136115 | 8/1988 | European Pat. Off. . | |
| 2035403 | 6/1980 | United Kingdom | 26/51.5 |

*Primary Examiner*—Werner H. Schroeder
*Assistant Examiner*—Amy Brooke Vanatta
*Attorney, Agent, or Firm*—Wegner, Cantor, Mueller & Player

[57] ABSTRACT

In a weft straightener having a machine frame (10); a pair of wheels (18) for holding each selvedge of a cloth (1) on the outer periphery (19) of each wheel (18); wheel supporting means (11 to 14, 16, 20) for keeping each wheel (18) rotatably, inclinably and widthwise-movably on each side of the machine frame (10); wheel inclination adjusting means (15, 31 to 36) for adjusting each wheel (18) to a desired inclination angle; and wheel position adjusting means (51 to 55) for adjusting each wheel (18) to a desired position in the widthwise direction; whereby the difference of rotation speed of both wheels (18) is made while the cloth (1) is travelling with its each selvedge held on the outer periphery (19) of each wheel (18) so that the skewed or bowed weft of the cloth (1) may be straightened, the improvement comprises a drum means (66, 67) mounted inclinably and projectingly on the inside of each wheel (18); drum supporting means (61, 65) for keeping each drum means (66, 67) rotatably and substantially in the widthwise direction on each side of the machine frame (10); and drum rotating means (63) for enabling each drum means (66, 67) to rotate interlocking with each wheel (18).

16 Claims, 4 Drawing Sheets

WEFT STRAIGHTENER

BACKGROUND OF THE INVENTION

This invention relates to a wheel type weft straightener which is suitable to be attached to various cloth treating machines such as those for dyeing, printing and finishing of natural and synthetic fiber cloths including woven and knitted fabrics, and straightens the skewed or bowed weft of a travelling cloth.

European Patent No. 0136115 and U.S. Pat. No. 4,932,106 disclose a weft straightener comprising a machine frame; a pair of wheels for holding each selvedge of a cloth on the outer periphery of each wheel; wheel supporting means for keeping each wheel rotatably, inclinably and widthwise-movably on each side of the machine frame; wheel inclination adjusting means for adjusting each wheel to a desired inclination angle; and wheel position adjusting means for adjusting each wheel to a desired position in the widthwise direction; whereby the difference of rotation speed of both wheels is made while the cloth is travelling with its each selvedge held on the outer periphery of each wheel so that the skewed or bowed weft of the cloth may be straightened.

However, the conventional wheel type weft straightener above mentioned had the problems that, when either selvedge of the cloth falls off from the outer periphery of the wheel due to causes such as partial unevenness of the selvedge, there is the possibility that the cloth being downwardly suspended gets partly caught in the inner members of the weft straightener or twines round the rotary members of the weft straightener, and operators cannot but interrupt the operation of the weft straightener to stop the travel of the cloth and treat the cloth to be restored to the former state by hand so that the selvedge of the cloth may be held again on the outer periphery of the wheel, so that it is difficult to efficiently restore the cloth by hand to the former state because the cloth has been downwardly suspended.

Furthermore, the conventional weft straightener, wherein each wheel which is free to rotate is provided and rotated, interlocking with each selvedge of the travelling cloth and stretching the cloth in the widthwise direction, had the drawbacks that they cannot be easily applied for those cloths such as knitted fabrics which are very stretchable and transformable, though they are preferably applied for those cloths such as woven fabrics which are not stretchable under usual tension.

Accordingly an object of the present invention is to provide a wheel type weft straightener wherein, when either selvedge of the cloth falls off from the outer periphery of the wheel, the/cloth is prevented from being downwardly suspended and the selvedge having fallen off comes to be held again on the outer periphery of the wheels as in the former state without the interruption of the operation of the weft straightener.

Furthermore, it is another object of the invention to provide a wheel type weft straightener which is preferably applied for not only the woven fabrics but also the knitted fabrics.

Other and further objects, features and advantages of the invention will become more apparent from the following description.

SUMMARY OF THE INVENTION

The objects as described above and further objects will be accomplished by the invention.

According to this invention, there is provided a weft straightener comprising a machine frame; a pair of wheels for holding each selvedge of a cloth on the outer periphery of each wheel; wheel supporting means for keeping each wheel rotatably, inclinably and widthwise-movably on each side of the machine frame; wheel inclination adjusting means for adjusting each wheel to a desired inclination angle; and wheel position adjusting means for adjusting each wheel to a desired position in the widthwise direction; whereby the difference of rotation speed between wheels is made while the cloth is travelling with its each selvedge held on the outer periphery of each wheel so that the skewed or bowed weft of the cloth may be straightened, characterized in that there is provided a drum means mounted inclinably and projectingly on the inside of each wheel; drum supporting means for keeping each drum means rotatably and substantially in the widthwise direction on each side of the machine frame; and drum rotating means for enabling each drum means to rotate interlocking with each wheel.

In this structure, each drum means is rotated together with each wheel while being kept in the widthwise direction by the drum supporting means and the drum rotating means, though each wheel is inclined and moved widthwise.

In this invention as described above, the weft straightener may have a structure, for example, wherein the drum supporting means comprises members for connecting the inside end of each drum means rotatably and widthwise-immovably with the machine frame; and the barrel of each drum means is composed of barrel members which are capable of expansion and contraction, and disposed linking each wheel to the inside end of each drum means, each joint being inclinable. In this case, when each wheel is inclined and moved widthwise, the barrel members follow the wheel while expanding or contracting widthwise, the inside end of each drum means being never moved widthwise.

Further, in this invention, the weft straightener may have a structure wherein the drum supporting means comprises members for connecting the inside end of each drum means rotatably and widthwise-movably with the machine frame; the barrel of each drum means is composed of barrel members which are capable of expansion and contraction, and disposed linking each wheel to the inside end of each drum means, each joint being inclinable; and there are provided with drum moving means for enabling the inside end of each drum means to move widthwise interlocking with each wheel. In this case, when each wheel is inclined, the barrel members follow the wheel while expanding or contracting widthwise, and when each wheel is moved widthwise, the inside end of each drum means and the barrel members follow up to the wheel while moving widthwise.

In each of the two structures as described above, the barrel members may be a plurality of elastic bars such as those made from rubbers or a plurality of telescopic bars arranged in a cylindrical shape. Each end of each telescopic bar may be inclinably connected through a universal joint with each wheel and the inside end of each drum means, respectively.

Further, in this invention, the weft straightener may have a structure wherein the drum supporting means comprise members for connecting the inside end of each drum means rotatably and widthwise-movably with the machine frame; the barrel of each drum means is composed of barrel members which are disposed linking each wheel to the inside end of each drum means, each joint being inclinable; and there are provided with drum inclining means for enabling the inside end of each drum means to incline interlocking with each wheel, and drum moving means for enabling the inside end of each drum means to move widthwise interlocking with each wheel. In this case, when each wheel is inclined, the barrel members follow up to the wheel while moving widthwise and the inside end of each drum means follows up to the wheel while inclining, and when each wheel is moved widthwise, the inside end of each drum means follows up to the wheel while moving widthwise.

In the structure as described above, the barrel members may be a plurality of rigid bars which are incapable of expansion and contraction, and arranged in a cylindrical shape, in which the drum inclining means comprise said bars. In this case, each end of each bar may be inclinably connected through a universal joint with each wheel and the inside end of each drum means, respectively, so that each bar may follow up to the wheel and the inside end of each drum means which are inclined.

Further, in this invention, the drum rotating means may comprise a synchronous universal joint for transmittably connecting the drum rotary shaft of each drum means with the wheel rotary shaft of each wheel. In this case, each drum means is rotated interlocking with each wheel though each wheel is inclined.

Further, in this invention, there may be provided weft sensors for detecting the skewing or bowing weft of the cloth; wheel driving means for rotating each wheel; and wheel differentially controlling means for controlling the wheel driving means according to the travelling speed of the cloth and for making both wheels to cause the difference of rotation speed according to the output signals of the weft sensors so that the skewed or bowed weft of the cloth may be straightened. In this case, both wheels are individually rotated by the wheel driving means positively to provide difference in the rotation speed corresponding to the skewing or bowing of the weft of the cloth, unlike both wheels in the prior arts in which each wheel is free to rotate and is rotated by each selvedge of the travelling cloth.

In the structure having the wheel driving means as described above, there may be provided a clutch means mounted on the transmission line between the wheel driving means and each wheel. In this case, when the clutch means is released, the transmission between the wheel driving means and each wheel is out of gearing and each wheel is made free to rotate so that it may be possible to straighten the weft of the cloth in the same manner as in the prior arts.

Further, in this invention, there may be provided selvedge sensors for detecting the position of each selvedge of the cloth on the outer periphery of each wheel; and wheel inclination controlling means for controlling the wheel inclination adjusting means according to those output signals of the selvedge sensors which indicate that either selvedge has fallen off from the outer periphery, to reduce the inclination angles of both wheels, preferably to zero. In this case, when either selvedge of the cloth falls off, the inclination angle of each wheel is automatically reduced to a desired angle so that the selvedge may be easily held again on the outer periphery of each wheel and restored to the former state.

In the structure having the wheel inclination controlling means as described above, after the inclination angles of both wheel are reduced, the wheel inclination controlling means may preferably control the wheel inclination adjusting means according to those output signals of the selvedge sensors which indicate each selvedge having been amended to travel being held on the outer periphery of each wheel, to restore the inclination angles of both wheels to the former state.

Further, the wheel inclination controlling means may be provided with a timer means for counting a preselected time just after the inclination angles of both wheels are reduced, and control the wheel inclination adjusting means according to that output signal of the timer means which indicates the preselected time having been counted over, to restore the inclination angles of both wheels to the former state. In this case, the time to be counted by the timer means should be selected with reference to those times taken for each selvedge to be amended to travel being held on the outer periphery of each wheel just after the inclination angles of both wheels are reduced which are experientially or experimentally obtainable as data under each condition of weft straightening.

Structures other than the features as described above in the invention can be suitably selected according to the prior arts which are modified or not.

For example, each selvedge of the cloth can be held on the outer periphery of each wheel so that it may be overfed enough, for example, being pinned with a group of pins projectingly implanted on the outer periphery of each wheel or being put between the outer periphery of each wheel and a endless belt pressed thereon. Each selvedge is preferably pushed on the outer periphery of each wheel with a brush roll which is rotatable and may be positively rotated by a driving means such as a motor if necessary.

Further, the wheel supporting means may have a structure, for example, wherein a wheel stand is provided widthwise-movably on each side of the machine frame; a variable-angle shaft is rotatably supported on each wheel stand at right angles in relation to the widthwise direction; and each wheel is rotatably supported on each variable-angle shaft in such a manner that a tangent extending from the cloth-holding starting position on the outer periphery of each wheel may be adjusted substantially to an axial line of each variable-angle shaft. In this structure, each wheel is preferably urged in the divergent direction by a spring mechanism so that the cloth is not tensioned widthwise over the resilience of the spring mechanism.

Further, the wheel inclination adjusting means may have a structure, for example, wherein each variable-angle shaft is rotated through a screw or gear means. In this structure, the wheel inclination adjusting means may be controlled by the wheel inclination controlling means in such a manner that, when the abnormal tension of the cloth in the widthwise direction or the interruption of the travel of the cloth is detected, the inclination angle of each cloth is automatically reduced.

Furthermore, the wheel position adjusting means may have a structure, for example, wherein each wheel stand is adjusted widthwise by a screw or gear means.

In this structure, the wheel position adjusting means may be controlled by wheel position controlling means according to the signals of selvedge sensors which detect the position of each selvedge of the cloth on the outer periphery of each wheel, so that the outer periphery of each wheel may automatically follow up to each selvedge.

BRIEF DESCRIPTION OF THE DRAWINGS

The present invention is more clearly illustrated in the accompanying drawings, wherein.

DETAILED DESCRIPTION OF THE PREFERRED EMBODIMENTS

The present invention will be described with reference to the attached drawings.

Figure 1:
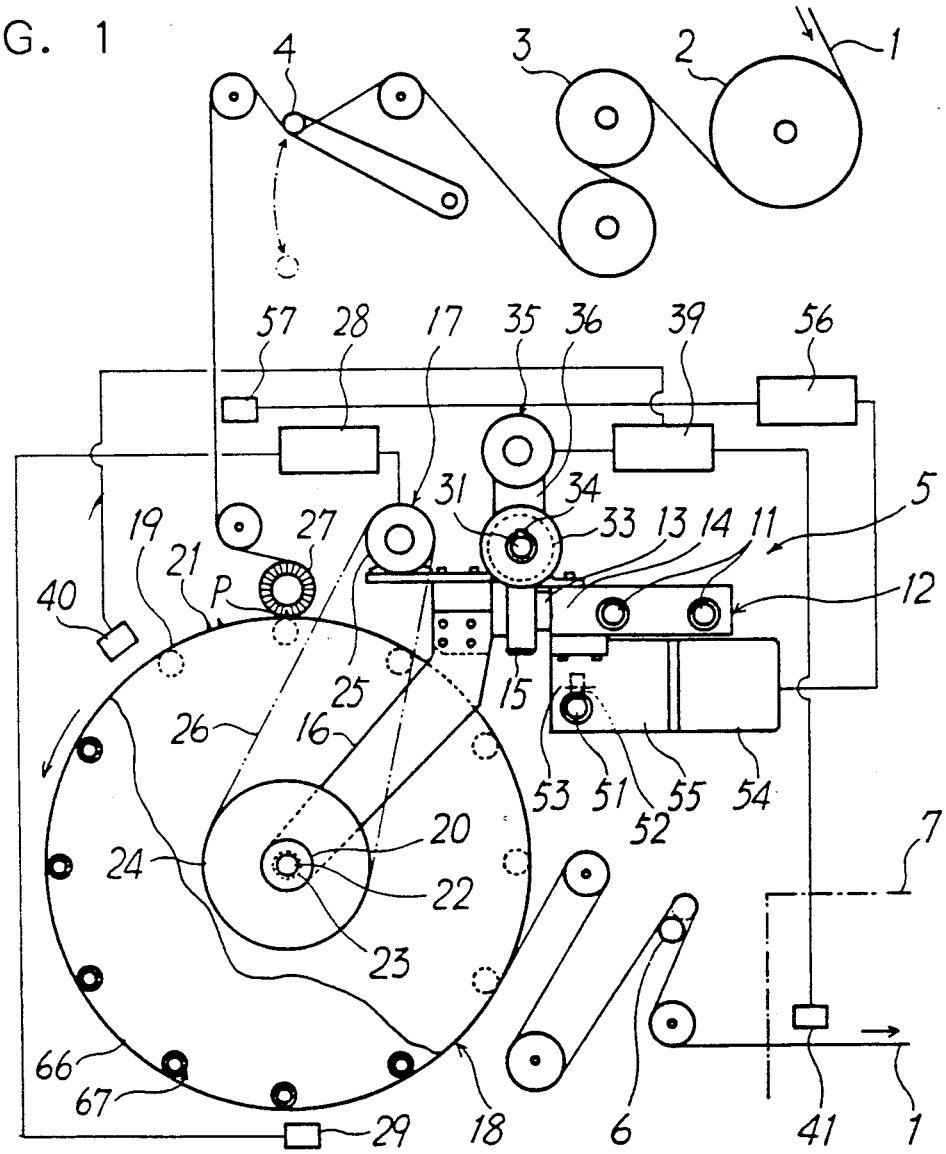
FIG. 1 is a side view showing the main part of a preferred weft straightener according to the present invention.

In FIG. 1, a cloth 1 is fed to a cloth treating machine 7 successively via a centering roll 2 for amending the travelling of the cloth 1 widthwise, a feed roll 3 for feeding the cloth 1, a dancer roll 4 for adjusting the lengthwise tension of the cloth 1, a weft straightening device 5 for straightening the skewed or bowed weft of the cloth 1, a bowed expander 6 for expanding the cloth 1 widthwise and so on, wherein the feeding amount of the cloth 1 supplied by the feed roll 3 is automatically adjusted in accordance with that rocking position of the dancer roll 4 which corresponds to the speed of the cloth 1 which is travelling on the cloth treating machine 7, the cloth 1 being supplied to the weft straightening device 5 with a constantly low tension in the lengthwise direction.

Figure 2:
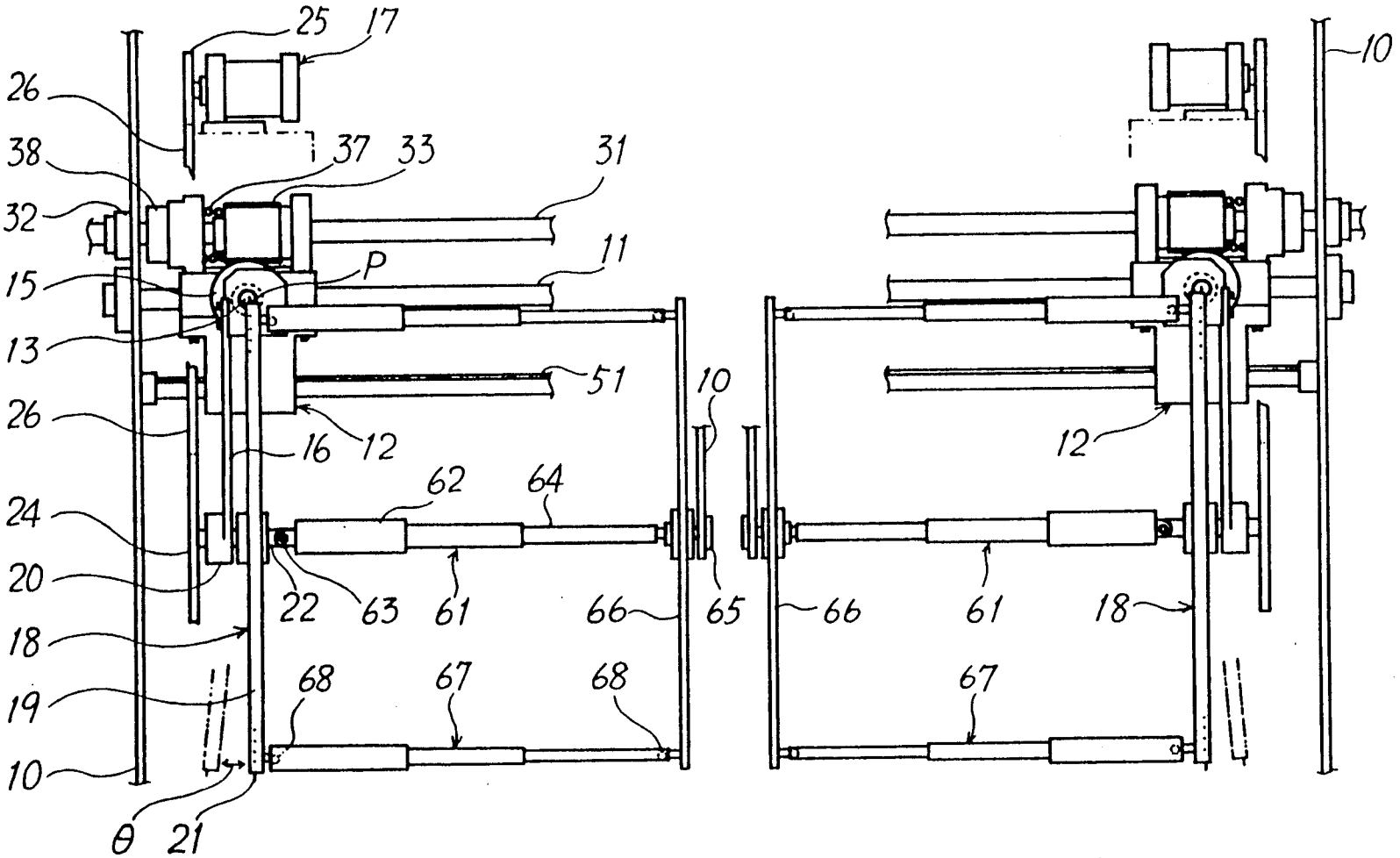
FIG. 2 is a front view showing the main part of a wheel operation mechanism of the weft straightener shown in FIG. 1.

Hereinafter, the weft straightening device 5, which contains the features of the present invention, will be explained in detail. In FIGS. 1 and 2, guide shafts 11, 11 are disposed widthwise linking both ends of a machine frame 10 and a wheel stand 12 is slidably mounted on each side of the guide shafts 11, 11. A variable-angle shaft 13 is rotatably supported on each wheel stand 12 through a bearing 14 at right angles in relation to the widthwise direction. A worm wheel 15 is attached coaxially to the middle of each variable-angle shaft 13, a forked arm 16 is attached to the end of each variable-angle shaft 13, extending obliquely downwardly, and a rotation control motor 17 (shown separately from each wheel stand 12 in FIG. 2 for clearness) is carried on the end of each variable-angle shaft 13. A wheel 18 is rotatably mounted on the lower end of each forked arm 16 through a bearing 20 in such a manner that a tangent extending from the cloth-holding starting position P on the upper end of the outer periphery 19 of the wheel 18 is adjusted substantially to the axial line of the variable-angle shaft 13. A plurality of pins 21—21 are projectingly implanted on the outer periphery 19 of each wheel 18 at a desired pitch. A coupled driving pulley 24 is supported on the wheel rotary shaft 22 of each wheel 18 through an over-running clutch 23, and a main driving pulley 25 is supported on the drive shaft of each rotation control motor 17. A transmission belt 26 is passed between the coupled driving pulley 24 and the main driving pulley 25. A brush roll 27 (not shown in FIG. 2) is rotatably supported widthwise on each end of the machine frame 10 through a bearing (not shown) in such a manner that it may engage with the pins 21—21 on the cloth-holding starting position P of the outer periphery 19 of each wheel 18.

Although not shown, other structures may be adopted, wherein the rotation control motor 17 is carried on the lower end of each forked arm 16 instead of being carried on the end of each variable-angle shaft 13; in case the cloth 1 is a knitted fabric, each brush roll 27 is positively rotated by a motor means instead of being free to rotate, so that the cloth 1 may be supplied on the outer periphery 19 of each wheel 18 in a sufficiently overfed state.

In the weft straightening device 5 as described above, the guide shafts 11, 11, the wheel stand 12, the variable-angle shaft 13, the bearing 14, the forked arm 16, the bearing 20 and the like on each side work together to make wheel supporting means; and the rotation control motor 17, the over-running clutch 23, the coupled driving pulley 24, the main driving pulley 25, the transmission belt 26 and the like work together to make wheel driving means.

In the wheel driving means, the rotation control motors 17, 17 on both sides are differentially controlled by wheel differentially controlling means 28 while being rotated according to the travelling speed of the cloth 1, wherein the wheel differentially controlling means 28 provides that wheels 18, 18 have a difference of rotation speed according to the output signals of weft sensors 29, 29 which are disposed over the cloth 1 held on the outer peripheries 19, 19 of both wheels 18, 18, so that the skewed or bowed weft of the cloth 1 may be straightened. In case the wheel driving means is not operated due to the releasing of the over-running clutch 23, each wheel 18 is made free to rotate and rotated interlocking with each selvedge of the cloth 1 as in the prior arts. Further, a worm shaft 31 is rotatably disposed widthwise linking both ends of machine frame 10 through bearings 32, 32, a worm 33 is carried on each side of the worm shaft 31 through a slide key 34, slidably but rotatably interlocking with the worm shaft 31, each worm 33 intermeshing with the worm wheel 15, being rotatably supported on the wheel stand 12 in the thrust direction, and the worm shaft 31 is transmittably connected to an angle control motor 35 through a gear device 36. A compression coiled spring 37 is disposed between the outside end of each worm 33 and each wheel stand 12 to urge the worm 33 to its inside direction, and an adjustment bolt 38 is screwed into each wheel stand 12 to push the outside end of the compression coiled spring 37 to its inside direction and to adjust the resilience of the compression coiled spring 37, wherein each wheel 18 is urged divergently under the urging of the compression coiled spring 37 in such a manner that the inclination angle $\theta$ of the wheel 18 tends to become larger.

In the structure above mentioned, the worm wheel 15, the worm shaft 31, the bearing 32, the worm 33, the slide key 34, the angle control motor 35, the gear device 36 and the like on each side work together to make wheel inclination adjusting means, wherein both wheels 18, 18 are inclined by the rotation of the worm shaft 31, in the opposite directions and by an equal angle of adjustment. As each wheel 18 is inclined substantially in relation to the tangent extending from the cloth-holding starting position P on the outer periphery 19 of the wheel 18, each cloth-holding starting position P is not displaced by the inclination of the wheel 18. In the wheel inclination adjusting means, each angle control motor 35 is controlled by wheel inclination controlling means 39 having a timer means (not shown), wherein the wheel inclination controlling means 39 reduce the inclination angle $\theta$ of each wheel 18 to zero according to those output signals of selvedge sensors 40, 40 disposed along the outer periphery 19 of each wheel 18 which indicate when either selvedge has fallen off from the outer periphery 19, and restore the inclination angle $\theta$ to the former state according to that output signal of the timer means which indicates the preselected time having been counted over. The wheel inclination controlling means 39 also reduce the inclination angle $\theta$ of each wheel 18 to zero according to that output signal of a cloth-travel sensor 41 disposed at the inlet of the cloth treating machine 7 which indicates the travel of the cloth 1 having been interrupted on the cloth treating machine 7, thus on the outer peripheries 19, 19 of both wheels 18, 18.

Although not shown, other structures may be adopted, wherein the interruption of the travel of the cloth 1 is detected by a cloth-travel sensor disposed within the weft straightener instead of being detected by the cloth-travel sensor 41 at the inlet of the cloth treating machine 7; and wherein the wheel inclination controlling means 39 restore the inclination angle 8 to the former state according to those output signals of the selvedge sensors 40, 40 instead of restoring it according to the output signal of the timer means. As described earlier, sensors 40, 40 indicate whether or not each selvedge is held on an outer periphery 19 of each corresponding wheel 18.

Furthermore, a rack 51 is disposed widthwise linking both ends of the machine frame 10 and a pinion 52 intermeshing with the rack 51 is rotatably supported on each wheel stand 12 through a bearing 53, the pinion 52 being transmittably connected to a position control motor 54 carried on the wheel stand 12, through a gear transmission 55.

Although not shown, another structure may be adopted, wherein a screw shaft intermeshing with each wheel stand 12 is rotatably disposed linking both ends of the machine frame 10 and rotated by a motor means instead of the pinion 52 intermeshing with the rack 51.

In the structure above mentioned, the rack 51, the pinion 52, the bearing 53, the position control motor 54, the gear transmission 55 and the like on each side work together to make wheel position adjusting means, wherein the wheel stand 12 is moved widthwise supporting the wheel 18 by the rotation of the pinion 52. In the wheel position adjusting means, the position control motor 54 is controlled by wheel position controlling means 56, which enable each wheel stand 12 to move widthwise and also enable the outer periphery 19 of each wheel 18 to automatically follow up to each selvedge of the cloth 1 according to the output signal of a selvedge sensor 57 carried on each wheel stand 12.

Further, a drum rotary shaft 61 which is telescopically composed of three stage members and capable of expansion and contraction, is disposed widthwise linking each wheel rotary shaft 22 to the middle of machine frame 10, wherein the outside end of the first stage member 62 is connected to the inside end of the wheel rotary shaft 22 through a synchronous universal joint 63 which transmits the input rotation to the output in the same rotation speed as that of the input; and the inside end of the third stage member 64 is rotatably supported on the middle of the machine frame 10. A secondary wheel 66 having almost the same diameter as that of the wheel 18 is carried on the inside end of the third stage member 64 of each drum rotary shaft 61, and a plurality of bars 67—67 (shown in FIG. 2 only by two on the upper and lower sides for clearness) which are telescopically composed of three stage members each and capable of expansion and contraction, are disposed widthwise linking each wheel 18 to each secondary wheel 66, near their outer peripheries in a cylindrical shape, wherein the wheel 18 and the outside end of each bar 67, and the secondary wheel 66 and the inside end of each bar 67 are inclinably connected through universal joints 68, 68, respectively.

Although not shown, other structures may be adopted, wherein elastic bars such as those made from rubbers and the like are used instead of the telescopic bars 67—67 in which it is not necessary to use the universal joints 68, 68 for connecting the outside end of each elastic bar with the wheel 18, and for connecting the inside end of each elastic bar with the secondary wheel 66, respectively, because the elastic bar is bendable in itself; and the secondary wheel 66 is carried on the first stage member 62, which is movable widthwise, of the drum rotary shaft 61 instead of being carried on the third member 64, which is widthwise-unmovably supported on the machine frame 10.

In the structure above mentioned, the secondary wheel 66 and the bars 67—67 on each side work together to make a drum means shaped like a cage or a slatted roll, in which the bars 67—67 make the barrel of the drum means as barrel members and the secondary wheel 66 makes the inside end of the drum means; the drum rotary shaft 61, the bearing 65 and the like work together to make drum supporting means; the synchronous universal joint 63 makes drum rotating means; and wherein, the drum rotary shaft 61 is rotated with all stage members united in one while being expanded or contracted, interlocking with the wheel 18, each bar 67 being rotated in relation to the drum rotary shaft 61 while being expanded or contracted, interlocking with the wheel 18, and the secondary wheel 66 being also rotated while being moved widthwise in case it is carried on the first stage member 62 of the drum rotary shaft 61, interlocking with the wheel 18, the drum rotary shaft 61 making drum moving means.

In the structure of the weft straightening device 5 above mentioned, the inclination angle 8 of each wheel 18 is preselected by the wheel inclination control means 39 so that both wheels 18, 18 are divergently disposed, and the resilience of each compression coiled spring 37 is adjusted by the adjustment bolt 38. The cloth 1 is moved to travel with its travelling course amended and with its lengthwise tension kept low, interlocking with each wheel 18, each selvedge of the cloth 1 being pushed on the outer periphery 19 of each wheel 18 with each brush roll 27 and pinned with the pins 21—21. The difference of rotation speed of both wheels 18, 18 is made according to the skewing or bowing of the weft of the cloth 1 to straighten the skewed or bowed weft, wherein, in case each wheel 18 is free to rotate, said difference of rotation speed is naturally made as disclosed in the prior arts; and in case each wheel 18 is positively rotated by the wheel driving means, said difference of rotation speed is made by the wheel differentially controlling means 28.

Under the straightening of the weft of the cloth 1, the outer periphery 19 of each wheel 18 is made to follow each selvedge of the cloth 1 by the wheel position controlling means 56. When either selvedge of the cloth 1 falls off from the outer periphery 19 and comes to be unpinned due to causes such as those of partial unevenness of the selvedge, the cloth 1 keeps its usual travelling while being stably supported on the bars 67—67 and the secondary wheels 66 on each side without being downwardly suspended, and the inclination angle $\theta$ of each wheel 18 is automatically reduced by the wheel inclination controlling means 39 and then automatically restored to the former state after the counting of the preselected time which is enough for the selvedge fallen off to come to be pinned again on the outer periphery 19. In case the travel of the cloth 1 is interrupted on the outer periphery 19, the inclination angle $\theta$ of each wheel 18 is also automatically reduced by the wheel inclination controlling means 39. Further, as the widthwise tension of the cloth 1 reacts upon each wheel 18 in such a manner that the inclination angle $\theta$ tends to become smaller, in case the cloth 1 is subject to abnormal tension in the widthwise direction, each compression coiled spring 37 is compressed to balance with said tension and the inclination angle $\theta$ is reduced so that the cloth 1 is prevented from deformation or rupture. Although not shown, with respect to a measure to counter said abnormal tension, another structure may be adopted, wherein the wheel inclination controlling means 39 reduce the inclination angle $\theta$ of each wheel 18 according to that output signal of a tension sensor disposed on the weft straightening device 5 which indicates the cloth 1 having been subject to abnormal tension.

Structures of the embodiment other than the weft straightening device 5 as described above can be suitably selected under each weft straightening condition according to the prior arts which are modified or not. Although not shown, with respect to the travelling process of the cloth 1, a structure different from that shown in FIG. 2 may be adopted, wherein the knitted cloth 1 is fed to the cloth treating machine 7 with a lower tension, successively via a screw expander for widthwise stretching each selvedge of the cloth 1, the feed roll 3, the centering roll 2, the weft straightening device 5 in which both wheels 18, 18 are preferably rotated differentially and each brush roll 27 is also preferably rotated, the bowed expander 6, the dancer roll 4 and so on.

Figure 3:
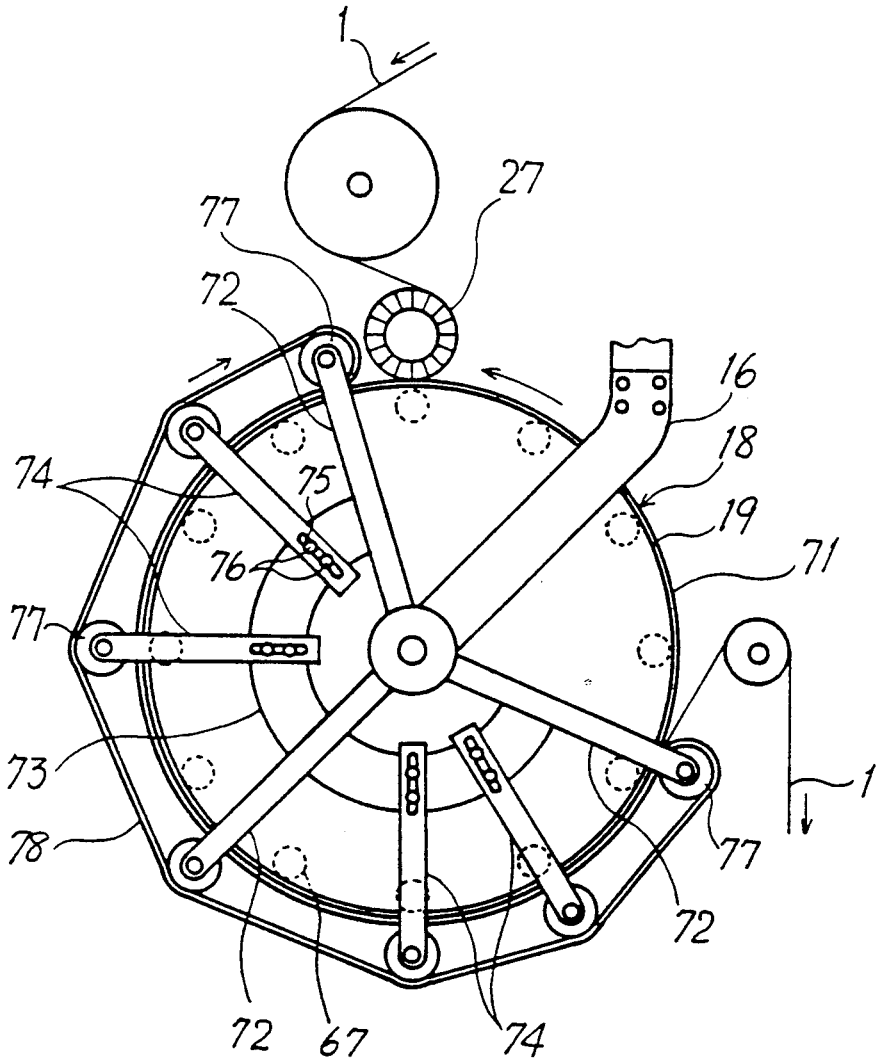
FIG. 3 is a side view showing the main part of another embodiment of a wheel according to the present invention.

Means for holding each selvedge, of the cloth 1 on the outer periphery 19 of the wheel 18, different from that shown in FIGS. 1 and 2, will be described hereinafter. In FIG. 3, a belt 71 is stuck on the outer periphery 19 of each wheel 18. Unmovable arms 72—72 are carried radially in relation to the wheel rotary shaft 22, on the lower end of the forked arm 16 at angles of about 15 to 245 degrees counterclockwise away from the angle position where the brush roll 27 is disposed, a supporting plate 73 is attached to the unmovable arms 72—72, and movable arms 74—74 are supported radially and adjustably in the radial direction on the supporting plate 73 among the unmovable arms 72—72, each movable arm 74 being held on the supporting plate 73 by screws 76, 76, each screw 76 being passed through a slotted hole 75 bored in the movable arm 74. A pulley 77 is rotatably supported on each end of the unmovable arms 72—72 and movable arms 74—74 in such a manner that both outer peripheries of the pulley 77 and the wheel 18 are opposite to each other, and a endless belt 78 is passed among the pulleys 77—77 at the positions from first to last, each pulley 77 at the first and last positions being pressed on the belt 71 through the endless belt 78, and each pulley 77 at the middle positions being far from the belt 71.

The endless belt 78 above mentioned is circulated interlocking with the wheel 18 in such a manner that the cloth 1 is held between the endless belt 78 and the belt 71, each selvedge of the cloth 1 being held on the outer periphery 19 of each wheel 18. The pressure of the endless belt 78 on the belt 71 is changeable by the radial adjustment of each movable arm 74.

Figure 4:
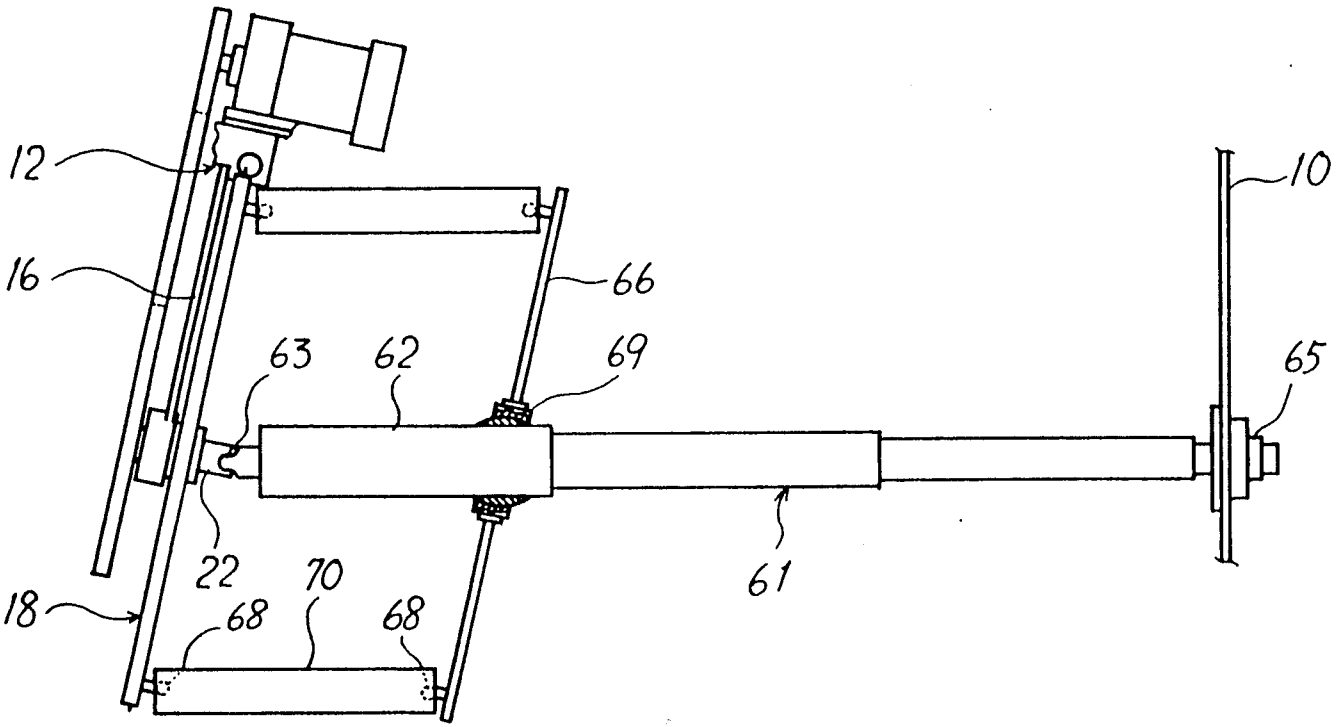
FIG. 4 is a front view showing the main part of another embodiment of a wheel operation mechanism according to the present invention.

Next, a wheel operation mechanism different from that shown in FIG. 2 will be described hereinafter. In FIG. 4, the drum rotary shaft 61 which is telescopically composed of three stage members and capable of expansion and contraction, is disposed widthwise in the same way as that shown in FIG. 2, wherein the secondary wheel 66 is inclinably carried on the inside end of the first stage member 62 through a rocking bearing 69; and a plurality of bars 70 two of which are shown in FIG. 4, on the upper and lower sides, for clearness which are rigid and incapable of expansion and contraction, are disposed widthwise linking the wheel 18 to the secondary wheel 66, near their outer peripheries in a cylindrical shape in which the wheel 18 and the outside end of each bar 70, and the secondary wheel 66 and the inside end of each bar 70 are inclinably connected through the universal joints 68, 68, respectively.

In the structure above mentioned, the secondary wheel 66 and the bars 70—70 work together to make another drum means shaped like a cage or a slatted roll in which the bars 70—70 make the barrel means as barrel members and the secondary wheel 66 makes the inside end of the drum means; the drum rotary shaft 61, the bearing 65, the rocking bearing 69 and the like work together to make another drum supporting means; the drum rotary shaft 61 makes drum moving means; and the universal joint 68, each bar 70 and the like work together to make another drum inclining means; and wherein the drum rotary shaft 61 is rotated with all stage members united in one while being expanded or contracted, interlocking with the wheel 18, each bar 70 being rotated in relation to the drum rotary shaft 61 while being moved widthwise, interlocking with the wheel 18, and the secondary wheel 66 being also rotated while being moved widthwise and inclined, interlocking with the wheel 18.

As many apparently widely different embodiments of this invention may be made without departing from the spirit and scope thereof, it is to be understood that the present invention is not limited to the specific embodiments thereof except as defined in the appended claims.

What is claimed is:

1. In a weft straightener having a machine frame (10); a pair of wheels (18) for holding each selvedge of a cloth (1) on an outer periphery (19) of each wheel (18); wheel supporting means (11 to 14, 16, 20) for keeping each wheel (18) rotatably, inclinably and widthwise-movably on each side of the machine frame (10); wheel inclination adjusting means (15, 31 to 36) for adjusting each wheel (18) to a desired inclination angle; wheel position adjusting means (51 to 55) for adjusting each wheel (18) to a desired position in a widthwise direction; and means for providing a difference of rotation speed between said wheels (18), while the cloth (1) is travelling with each said selvedge held on an outer periphery (19) of each wheel (18) and with a weft of said cloth skewed, so as to straighten said skewed weft of the cloth (1), the improvement comprising:

drum means (66, 67), mounted inclinably and projectingly on an inside of each wheel (18), for supporting an edge portion of said cloth when a corresponding portion of said selvedge disconnects from said wheel outer periphery;

drum supporting means (61, 65) for keeping each drum means (66, 67) rotatably and substantially in a widthwise direction on each side of the machine frame (10); and drum rotating means (63) for enabling each drum means (66, 67) to rotate interlocking with each wheel (18).

2. The improvement according to claim 1, and further comprising:

means for connecting an inside end (66) of each drum means (66, 67) rotatably and widthwise-immovably with the machine frame (10); and said drum means (66, 67) comprising expansible and contractable barrel members (67) and joints linking each wheel (18) to an inside end (66) of each corresponding drum means (66, 67), each said joint being inclinable.

3. The improvement according to claim 1, and further comprising:

means (61, 65) for connecting an inside end (66) of each drum means (66, 67) rotatably an widthwise-movably with the machine frame (10);

said drum means (66, 67) comprising expansible and contractable barrel members (67) and joints linking each wheel (18) to an inside end (66) of each corresponding drum means (66, 67), each said joint being inclinable; and drum moving means (61) for enabling the inside end (66) of each drum means (66, 67) to move widthwise interlocking with each wheel (18).

4. The improvement according to claim 2, wherein the barrel members comprise a plurality of elastic bars arranged in a cylindrical shape.

5. The improvement according to claim 2, wherein the barrel members comprise a plurality of telescopic bars (67) arranged in a cylindrical shape.

6. The improvement according to claim 5, and further comprising:

universal joint means (68) for inclinably connecting each said bar with each wheel (18) and the inside end (66) of each drum means (66, 67), respectively.

7. The improvement according to claim 1, and further comprising:

means (61, 65) for connecting an inside end (66) of each drum means (66, 67) rotatably and widthwise-movably with the machine frame (10);

said drum means (66, 70) comprising expansible and contractable barrel members (70) and joints linking each wheel (18) to an inside end (66) of each corresponding drum means (66, 70), each said joint being inclinable;

drum inclining means (68, 70) for enabling the inside end (66) of each drum means (66, 70) to incline interlocking with each wheel (18); and drum moving means (61) for enabling the inside end (66) of each drum means (66, 70) to move widthwise interlocking with each wheel (18).

8. The improvement according to claim 1, and further comprising:

means (61, 65) for connecting an inside end (66) of each drum means (66, 67) rotatably and widthwise-movably with the machine frame (10);

said drum means (66, 70) comprising barrel members which are incapable of expansion and contraction and joints linking each wheel (18) to an inside end (66) of each corresponding drum means (66, 70), each said joint being inclinable;

drum inclining means (68, 70) for enabling the inside end (66) of each drum means (66, 70) to incline interlocking with each wheel (18), said barrel members and said drum inclining means comprising a plurality of rigid bars arranged in a cylindrical shape; and drum moving means (61) for enabling the inside end (66) of each drum means (66, 70) to move widthwise interlocking with each wheel (18).

9. The improvement according to claim 1, wherein the drum rotating means comprise:

a synchronous universal joint (63) for transmittably connecting a drum rotary shaft (61) of each drum means (66, 70) with a wheel rotary shaft (22) of each wheel (18).

10. The improvement according to claim 1, and further comprising:

weft sensor means (29) for detecting the skewing of the weft of the cloth (10) and outputting signals in accordance therewith;

wheel driving means (17, 23 to 26) for rotating each wheel (18); and wheel differentially controlling means (28) for controlling the wheel driving means (17, 23 to 26) and, thus, the difference of rotation speed of the wheels according to the output signals of the weft sensor means (29) so as to straighten the skewed weft of the cloth (1).

11. The improvement according to claim 10, and further comprising:

a clutch (23) mounted on a transmission line between the wheel driving means (17, 23 to 26) and each wheel (18).

12. The improvement according to claim 1, and further comprising:

selvedge sensor means (40) for detecting positioning of each selvedge of the cloth (1) relative to the outer periphery (19) of each wheel (18) and outputting selvedge signals indicative of said positioning; and wheel inclination controlling means (39) for controlling the wheel inclination adjusting means (15, 31 to 36) and reducing the inclination angles of the wheels, according to said selvedge signals when either selvedge falls off from the outer periphery (19) of each wheel (18).

13. The improvement according to claim 12, wherein the wheel inclination controlling means (39) further comprise:

means for controlling the wheel inclination adjusting means (15, 31 to 36) and restoring said inclination angles of both wheels to a state prior to said selvedge falling off said periphery according to said selvedge signals after each selvedge has been amended to travel while being held on the outer periphery (19) of each wheel (18).

14. The improvement according to claim 12, wherein the wheel inclination controlling means (39) further comprises:

timer means for counting a preselected time just after the inclination angles of both wheels (18) are reduced and outputting a signal in accordance therewith, and means for controlling the wheel inclination adjusting means (15, 31 to 36) according to said output signal of the timer means so as to restore the inclination angles of both wheels (18) to a prior state.

15. The improvement according to claim 2, wherein the barrel members comprise a plurality of elastic bars arranged in a cylindrical shape.

16. The improvement according to claim 2, wherein the barrel members comprise a plurality of telescopic bars (67) arranged in a cylindrical shape.

* * * * *